US011319132B2

(12) United States Patent
Balazs

(10) Patent No.: US 11,319,132 B2
(45) **Date of Patent: *May 3, 2022**

(54) PLASTIC CORRUGATED CONTAINER WITH SOFT SCORE LINE

(71) Applicant: ORBIS Corporation, Oconomowoc, WI (US)

(72) Inventor: Donald J. Balazs, Oconomowoc, WI (US)

(73) Assignee: ORBIS Corporation, Oconomowoc, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/189,913

(22) Filed: Mar. 2, 2021

(65) Prior Publication Data

US 2021/0237958 A1 Aug. 5, 2021

Related U.S. Application Data

(63) Continuation of application No. 16/822,107, filed on Mar. 18, 2020, now Pat. No. 10,961,038, which is a (Continued)

(51) Int. Cl.

| | |
|---|---|
| ***B65D 77/22*** | (2006.01) |
| ***B65D 5/42*** | (2006.01) |
| ***B31F 1/10*** | (2006.01) |
| ***B31B 50/25*** | (2017.01) |
| ***B31B 50/26*** | (2017.01) |

(Continued)

(52) U.S. Cl.

CPC ..... *B65D 77/22* (2013.01); *B31B 50/252* (2017.08); *B31B 50/256* (2017.08); *B31B 50/26* (2017.08); *B31F 1/10* (2013.01); *B65D 5/4266* (2013.01); *B65D 65/403* (2013.01); *B31B 2100/0022* (2017.08); *B31B 2105/001* (2017.08);

(Continued)

(58) Field of Classification Search

CPC ..... B31B 50/25; B31B 50/252; B31B 50/256; B31B 50/26; B31B 2100/00; B65D 65/403

See application file for complete search history.

(56) References Cited

U.S. PATENT DOCUMENTS

| | | | |
|---|---|---|---|
| 1,101,927 | A | 6/1914 | Hawkins et al. |
| 1,733,566 | A | 10/1929 | Weaver |

(Continued)

FOREIGN PATENT DOCUMENTS

| | | | |
|---|---|---|---|
| CA | 2935978 | A1 | 4/2013 |
| CA | 2961959 | A1 | 4/2016 |

(Continued)

OTHER PUBLICATIONS

The International Bureau of WIPO, International Preliminary Report on Patentability for PCT/US2012/038316, dated Apr. 15, 2014, 9 pages.

(Continued)

*Primary Examiner* — Justin M Larson

(74) *Attorney, Agent, or Firm* — Greensfelder, Hemker & Gale, P.C.; Richard C. Himelhoch

(57) ABSTRACT

A box formed from a plastic corrugated material with soft score lines is provided. The soft score lines are formed to enable the top flaps of the box to lay substantially flat against the outer surface of the box when folded to an open position.

20 Claims, 5 Drawing Sheets

Related U.S. Application Data continuation of application No. 15/629,806, filed on Jun. 22, 2017, now Pat. No. 10,625,916, which is a continuation-in-part of application No. 14/580,810, filed on Dec. 23, 2014, now Pat. No. 10,829,264.

(60) Provisional application No. 62/354,483, filed on Jun. 24, 2016, provisional application No. 61/920,570, filed on Dec. 24, 2013.

(51) Int. Cl.

| | |
|---|---|
| ***B65D 65/40*** | (2006.01) |
| ***B31B 105/00*** | (2017.01) |
| ***B31B 100/00*** | (2017.01) |
| ***B65D 5/02*** | (2006.01) |
| ***B31B 110/35*** | (2017.01) |

(52) U.S. Cl.

CPC ... *B31B 2105/0022* (2017.08); *B31B 2110/35* (2017.08); *B65D 5/02* (2013.01)

(56) References Cited

U.S. PATENT DOCUMENTS 2,533,773 A 12/1950 De La Foret
2,751,136 A 6/1956 Moore
3,199,763 A 8/1965 Anderson
3,203,288 A 8/1965 Blumer
3,349,446 A 10/1967 Haygeman
3,406,052 A 10/1968 Peters
3,414,184 A 12/1968 Loheed
3,562,041 A 2/1971 Robertson
3,611,884 A 10/1971 Hottendorf
3,687,170 A 8/1972 Malone et al.
3,727,825 A 4/1973 Troth
3,727,826 A 4/1973 Shepherd
3,768,724 A 10/1973 Hill
3,796,307 A 3/1974 McKinney
3,883,065 A 5/1975 Presnick
3,884,132 A 5/1975 Snodgrass
3,907,193 A 9/1975 Heller
3,929,536 A 12/1975 Maughan
3,973,721 A 8/1976 Nakane
3,977,310 A 8/1976 Keck et al.
3,981,213 A 9/1976 Lopman
4,011,798 A 3/1977 Bambara et al.
4,027,058 A 5/1977 Wootten
4,064,206 A * 12/1977 Seufert ..... B31F 1/08 264/479
4,090,903 A 5/1978 Matsui
4,106,623 A 8/1978 Carroll et al.
4,121,754 A 10/1978 Hackenberg
4,239,150 A 12/1980 Schadowski et al.
4,267,223 A 5/1981 Swartz
4,313,547 A 2/1982 Osborne
4,348,449 A 9/1982 Seufert
4,356,053 A 10/1982 LoMaglio
4,358,498 A 11/1982 Chavannes
4,415,515 A 11/1983 Rosenberg
4,441,948 A 4/1984 Gillard et al.
4,477,013 A 10/1984 Herrin
4,477,522 A 10/1984 Sheehan
4,482,417 A 11/1984 Hulber et al.
4,507,348 A 3/1985 Nagata et al.
4,515,648 A 5/1985 Kolbe et al.
4,517,790 A 5/1985 Kreager
4,530,196 A 7/1985 O'Bryan
4,535,929 A 8/1985 Sherman, II et al.
4,559,259 A 12/1985 Cetrelli
4,596,541 A 6/1986 Ward, Sr. et al.
4,601,407 A 7/1986 Gillard
4,604,083 A 8/1986 Barny et al.
4,605,454 A 8/1986 Sayovitz et al.
4,623,072 A 11/1986 Lorenz
4,655,389 A 4/1987 Marsh
4,767,393 A 8/1988 Smith
4,784,269 A 11/1988 Griffith
4,865,201 A 9/1989 Liebel
4,906,510 A 3/1990 Todor, Jr. et al.
4,938,413 A 7/1990 Wolfe
4,946,430 A 8/1990 Kohmann
4,948,039 A 8/1990 Amatangelo
4,960,207 A 10/1990 Tabler et al.
5,012,930 A 5/1991 Hansen
5,021,042 A 6/1991 Resnick et al.
5,054,265 A 10/1991 Perigo et al.
5,094,385 A 3/1992 Antczak et al.
5,114,034 A 5/1992 Miller et al.
5,158,525 A 10/1992 Nikkel
5,163,609 A 11/1992 Muise, Jr.
5,183,672 A 2/1993 Fetterhoff et al.
5,190,213 A 3/1993 Horwitz
5,202,065 A 4/1993 Lenander et al.
5,232,149 A 8/1993 Stoll
5,255,842 A 10/1993 Rosen
5,268,138 A 12/1993 Fetterhoff et al.
5,304,056 A 4/1994 Fetterhoff
5,340,632 A 8/1994 Chappuis
5,351,846 A 10/1994 Carter
5,356,696 A 10/1994 Fetterhoff
5,358,174 A 10/1994 Antczak et al.
5,384,002 A 1/1995 Leatherman et al.
5,466,211 A 11/1995 Komarek et al.
5,497,939 A 3/1996 Heiskell et al.
5,501,758 A 3/1996 Nitardy
5,503,324 A 4/1996 Bacchetti et al.
5,533,956 A 7/1996 Komarek et al.
5,564,623 A 10/1996 Kiley
5,597,111 A 1/1997 Mackinnon et al.
5,658,644 A 8/1997 Ho et al.
5,681,422 A 10/1997 Marschke
5,733,411 A 3/1998 Bett
5,765,688 A 6/1998 Bertram et al.
5,873,807 A 2/1999 Lauderbaugh et al.
5,878,554 A 3/1999 Loree et al.
5,881,902 A 3/1999 Ackermann
5,887,782 A 3/1999 Mueller
5,908,135 A 6/1999 Bradford et al.
5,913,766 A 6/1999 Reed et al.
5,924,627 A 7/1999 Wilder et al.
5,965,238 A 10/1999 Saitoh et al.
6,007,470 A 12/1999 Komarek et al.
6,039,101 A 3/2000 MacKinnon
6,056,840 A 5/2000 Mills et al.
6,071,225 A 6/2000 Kucharski
6,102,279 A 8/2000 Dowd
6,102,280 A 8/2000 Dowd
6,120,629 A 9/2000 Shannon et al.
6,126,067 A 10/2000 Grigsby, Jr. et al.
6,138,903 A 10/2000 Baker
6,159,137 A 12/2000 Lee et al.
6,203,482 B1 3/2001 Sandford
6,257,484 B1 7/2001 Dowd
6,338,234 B1 1/2002 Muise et al.
6,349,876 B1 2/2002 Dowd
6,450,398 B1 9/2002 Muise et al.
6,572,519 B1 6/2003 Harris
6,578,759 B1 6/2003 Ortiz
6,592,711 B1 7/2003 Kubik
6,655,434 B2 12/2003 Danko
6,676,010 B1 1/2004 Roseth et al.
6,689,033 B2 2/2004 Plemons et al.
6,705,515 B2 3/2004 Dowd
6,719,191 B1 4/2004 Christensen et al.
6,759,114 B2 7/2004 Wu et al.
6,761,307 B2 7/2004 Matsuoka
6,769,548 B2 8/2004 Morell et al.
6,902,103 B2 6/2005 Machery
6,926,192 B1 8/2005 Dowd
6,938,818 B2 9/2005 Moorman et al.
6,994,662 B2 2/2006 Jornborn et al.
7,025,841 B2 4/2006 Owen
7,028,834 B2 4/2006 Karpel
7,069,856 B2 7/2006 Hartka et al.

(56) References Cited

U.S. PATENT DOCUMENTS

| | | | | |
|---|---|---|---|---|
| 7,326,168 | B2 | 2/2008 | Kocherga et al. | |
| 7,384,497 | B2 | 6/2008 | Christensen et al. | |
| D608,634 | S | 1/2010 | Riedi | |
| 7,640,662 | B2 | 1/2010 | Haglid | |
| 7,670,275 | B2 | 3/2010 | Schaack | |
| 7,682,300 | B2 | 3/2010 | Graham et al. | |
| 7,726,480 | B2 | 6/2010 | Nazari | |
| 7,784,674 | B2 | 8/2010 | Grigsby | |
| 7,870,992 | B2 | 1/2011 | Schille et al. | |
| 7,886,503 | B2 | 2/2011 | Chase et al. | |
| 7,951,252 | B2 | 5/2011 | Danko | |
| 8,418,912 | B1 | 4/2013 | Goodrich | |
| 8,469,257 | B2 | 6/2013 | Maillot | |
| 8,662,133 | B2 | 3/2014 | Ninomiya et al. | |
| 8,662,378 | B2 | 3/2014 | Mehta | |
| 8,864,017 | B2 | 10/2014 | McMahon | |
| 9,126,711 | B2 | 9/2015 | Hermosillo et al. | |
| 9,302,806 | B2 | 4/2016 | Perkins | |
| 9,555,918 | B2 | 1/2017 | McMahon | |
| 9,573,722 | B1 | 2/2017 | Capogrosso | |
| 9,604,750 | B2 | 3/2017 | McMahon et al. | |
| 9,630,736 | B2 | 4/2017 | Oliveira | |
| 9,630,739 | B2 | 4/2017 | McMahon et al. | |
| 9,999,697 | B2 | 6/2018 | Antoine et al. | |
| 10,199,811 | B2 | 2/2019 | Chu et al. | |
| 10,252,832 | B2 | 4/2019 | McMahon | |
| 10,392,153 | B2 | 8/2019 | Mehta | |
| 10,583,955 | B2 | 3/2020 | Ackroyd et al. | |
| 10,625,916 | B2 | 4/2020 | Balazs | |
| 10,829,264 | B2 | 11/2020 | McMahon et al. | |
| 10,829,265 | B2 | 11/2020 | Balazs et al. | |
| 10,961,038 | B2 | 3/2021 | Balazs | |
| 11,072,140 | B2 * | 7/2021 | McMahon | B29C 65/7443 |
| 11,072,455 | B2 * | 7/2021 | McMahon | B29C 67/0044 |
| 2001/0022211 | A1 | 9/2001 | Walsh | |
| 2001/0027992 | A1 | 10/2001 | Strong | |
| 2001/0046584 | A1 | 11/2001 | Danko | |
| 2002/0007607 | A1 | 1/2002 | Matlack et al. | |
| 2002/0011513 | A1 | 1/2002 | Dowd | |
| 2002/0026742 | A1 | 3/2002 | Washington | |
| 2002/0125594 | A1 | 9/2002 | Sung et al. | |
| 2003/0010817 | A1 | 1/2003 | Lingle et al. | |
| 2003/0102361 | A1 | 6/2003 | Terashima et al. | |
| 2003/0127773 | A1 | 7/2003 | Feistel et al. | |
| 2003/0215613 | A1 | 11/2003 | Jan et al. | |
| 2003/0235660 | A1 | 12/2003 | Blanchard | |
| 2004/0222542 | A1 | 11/2004 | Jan et al. | |
| 2004/0248717 | A1 | 12/2004 | Calugi | |
| 2005/0006446 | A1 | 1/2005 | Stafford, Jr. | |
| 2005/0067084 | A1 | 3/2005 | Kagan et al. | |
| 2005/0067477 | A1 | 3/2005 | McClure | |
| 2005/0150244 | A1 | 7/2005 | Hillmann et al. | |
| 2005/0202215 | A1 | 9/2005 | Temple, II et al. | |
| 2005/0209076 | A1 | 9/2005 | Boutron et al. | |
| 2006/0089071 | A1 | 4/2006 | Leidig et al. | |
| 2006/0169757 | A1 | 8/2006 | McDowell | |
| 2007/0069428 | A1 | 3/2007 | Pfaff et al. | |
| 2007/0228129 | A1 | 10/2007 | Habeger, Jr. et al. | |
| 2007/0241900 | A1 | 10/2007 | Sasazaki | |
| 2007/0296890 | A1 | 12/2007 | Mizushima et al. | |
| 2008/0003869 | A1 | 1/2008 | Wu et al. | |
| 2008/0003870 | A1 | 1/2008 | Wu et al. | |
| 2008/0048367 | A1 * | 2/2008 | Falat | B31F 1/08 264/442 |
| 2008/0247682 | A1 | 10/2008 | Murray | |
| 2009/0011173 | A1 | 1/2009 | Thiagarajan | |
| 2009/0280973 | A1 | 11/2009 | Graham et al. | |
| 2010/0078466 | A1 | 4/2010 | Stack, Jr. et al. | |
| 2010/0105534 | A1 | 4/2010 | Nazari | |
| 2010/0147840 | A1 | 6/2010 | Dowd | |
| 2011/0069911 | A1 | 3/2011 | Ackerman et al. | |
| 2011/0101081 | A1 | 5/2011 | Dowd et al. | |
| 2011/0303740 | A1 | 12/2011 | Schuld | |
| 2012/0118880 | A1 | 5/2012 | Wnek | |
| 2013/0048704 | A1 | 2/2013 | Lewis et al. | |
| 2013/0055407 | A1 | 4/2013 | McMahon | |
| 2013/0092726 | A1 | 4/2013 | McMahon | |
| 2014/0231496 | A1 | 8/2014 | McMahon | |
| 2014/0231497 | A1 | 8/2014 | McMahon | |
| 2014/0367458 | A1 | 12/2014 | Smith | |
| 2014/0367459 | A1 | 12/2014 | Smith | |
| 2014/0374303 | A1 | 12/2014 | Martinez | |
| 2015/0174849 | A1 | 6/2015 | McMahon et al. | |
| 2015/0174850 | A1 | 6/2015 | McMahon et al. | |
| 2015/0175297 | A1 | 6/2015 | McMahon et al. | |
| 2015/0175298 | A1 | 6/2015 | McMahon et al. | |
| 2015/0210421 | A1 | 7/2015 | Whittles et al. | |
| 2016/0096651 | A1 | 4/2016 | Klein | |
| 2016/0102196 | A1 | 4/2016 | Dodd | |
| 2017/0066214 | A1 | 3/2017 | Polikov | |
| 2017/0291731 | A1 | 10/2017 | Balazs et al. | |
| 2017/0369221 | A1 | 12/2017 | Balazs | |
| 2018/0105316 | A1 | 4/2018 | McMahon et al. | |
| 2018/0362207 | A1 | 12/2018 | McMahon et al. | |
| 2019/0270542 | A1 | 9/2019 | McMahon | |
| 2019/0300210 | A1 | 10/2019 | Ponti | |
| 2020/0216249 | A1 | 7/2020 | Balazs | |
| 2021/0031970 | A1 | 2/2021 | Balazs et al. | |
| 2021/0139188 | A1 * | 5/2021 | McMahon | B65D 5/3621 |
| 2021/0237958 | A1 * | 8/2021 | Balazs | B31B 50/252 |
| 2021/0371155 | A1 * | 12/2021 | McMahon | B29C 67/0044 |

FOREIGN PATENT DOCUMENTS

| | | | |
|---|---|---|---|
| CA | 2851357 | C | 8/2016 |
| CA | 3028971 | A1 | 12/2017 |
| CA | 3037138 | C | 4/2021 |
| DE | 9110957 | U1 | 11/1991 |
| DE | 102010041663 | A1 | 3/2012 |
| EP | 0054856 | A1 | 6/1982 |
| EP | 0330228 | A2 | 8/1989 |
| EP | 0330228 | A3 | 8/1989 |
| EP | 0399657 | A1 | 11/1990 |
| EP | 0459672 | A1 | 12/1991 |
| EP | 0535998 | A1 | 4/1993 |
| EP | 0566338 | A1 | 10/1993 |
| EP | 0731233 | A1 | 9/1996 |
| EP | 1488912 | A1 | 12/2004 |
| EP | 1880947 | A2 | 1/2008 |
| EP | 1787801 | B1 | 8/2009 |
| EP | 1799432 | B1 | 1/2010 |
| EP | 2766269 | | 8/2014 |
| EP | 2766269 | B1 | 12/2016 |
| EP | 3170759 | A1 | 5/2017 |
| EP | 3170760 | A1 | 5/2017 |
| EP | 3089917 | B1 | 6/2018 |
| EP | 3486188 | A1 | 5/2019 |
| EP | 3865415 | A1 | 8/2021 |
| GB | 1593730 | A | 7/1981 |
| GB | 2199017 | A | 6/1988 |
| GB | 2249520 | A | 5/1992 |
| GB | 2271095 | A | 4/1994 |
| GB | 2276120 | A | 9/1994 |
| GB | 2299048 | A | 9/1996 |
| JP | S597014 | A | 1/1984 |
| JP | 3266630 | A | 11/1991 |
| JP | 5146996 | A | 6/1993 |
| JP | 08-085148 | A | 4/1996 |
| JP | 2003340936 | A | 5/2002 |
| JP | 2003062917 | A | 3/2003 |
| JP | 2003104361 | | 4/2003 |
| JP | 2005343554 | A | 12/2005 |
| JP | 2006001136 | A | 1/2006 |
| JP | 2009006556 | A | 1/2009 |
| KR | 20020006235 | A | 1/2002 |
| KR | 20100137130 | A | 12/2010 |
| KR | 10-2016-0054489 | | 5/2016 |
| MX | 9503047 | A | 2/1997 |
| MX | 343734 | B | 11/2016 |
| MX | 2017004472 | A | 6/2017 |
| MX | 353612 | B | 1/2018 |
| MX | 364678 | B | 5/2019 |
| TW | 356126 | | 4/1999 |
| TW | 416925 | B | 1/2001 |

(56) References Cited

FOREIGN PATENT DOCUMENTS

| | | | |
|---|---|---|---|
| TW | 200619094 | | 6/2006 |
| TW | 306060 | B | 2/2009 |
| TW | 201345796 | A | 11/2013 |
| TW | I555683 | B | 11/2016 |
| TW | 201716293 | A | 5/2017 |
| TW | 201716294 | A | 5/2017 |
| TW | I600591 | B | 10/2017 |
| TW | I600592 | B | 10/2017 |
| WO | 9309032 | A1 | 5/1993 |
| WO | 2005120965 | A1 | 12/2005 |
| WO | 2006034502 | A1 | 3/2006 |
| WO | 2007105964 | A1 | 9/2009 |
| WO | 2010049880 | A2 | 5/2010 |
| WO | 2012055429 | A1 | 5/2012 |
| WO | 2013055407 | A1 | 4/2013 |
| WO | 2015100249 | A2 | 7/2015 |
| WO | 2016057256 | A1 | 4/2016 |
| WO | 2017223392 | A1 | 12/2017 |
| WO | 2018156604 | A1 | 8/2018 |
| WO | 2018236801 | A1 | 12/2018 |

OTHER PUBLICATIONS

European Patent Office, Extended European Search Report for EP 18174415.2, dated Mar. 26, 2019, 7 pages.
European Patent Office, International Search Report for PCT/US2012/038316, dated Aug. 2, 2012, 5 pages.
European Patent Office, Extended European Search Report for EP 15849285.0, dated Feb. 7, 2018, 8 pages.
European Patent Office, Written Opinion of International Searching Authority for PCT/US2012/038316, dated Aug. 2, 2012, 8 pages.
European Patent Office, Extended European Search Report for EP Application No. 18821166.8, dated May 28, 2021, 10 pages.
European Patent Office, Extended European Search Report for EP Application No. 21166046.9, dated Jun. 30, 2021, 7 pages.
Tri-Pack Plastics Ltd.; Web pages for "Chilled Foods," "Polypropylene Packaging," "Tree Tubes," "Transit Packaging," and "Returnable Post"; retrieved Jan. 18, 2010 from <http://www.tri-pack.co.uk/> and related sites, 9 pages.
Wikipedia article: "Corrugated Fiberboard"; retrieved from <http://en.wikipedia.org/w/index.php?title=Corrugated_fiberboard&oldid=648589914> on Mar. 3, 2015, 7 pages.
European Patent Office, Partial International Search Report for PCT/US2014/071926 dated Apr. 28, 2015, 5 pages.
European Patent Office, International Search Report for PCT/US2014/071926 dated Jun. 30, 2015, 6 pages.
Taiwanese Patent Office, Search Report for Taiwanese Application No. 101137741, dated Jun. 23, 2016, 1 page, with English translation.
European Patent Office, Extended European Search Report for EP 16204731.0, dated Feb. 3, 2017, 9 pages.
European Patent Office, Extended European Search Report for EP 16204728.6, dated Feb. 3, 2017, 10 pages.
Taiwanese Intellectual Property Office, Office Action and Search Report for TW Application No. 105123775, dated Mar. 8, 2017, with English translation, 5 pages.
Taiwanese Intellectual Property Office, Office Action and Search Report for TW Application No. 105123777, dated Mar. 8, 2017, with English translation, 5 pages.
European Patent Office, Written Opinion of the International Searching Authority for PCT/US2014/071926, dated Jun. 30, 2015, 6 pages.
The International Bureau of WIPO, International Preliminary Report on Patentability for PCT/US2014/071926, dated Jun. 28, 2016, 7 pages.
The International Bureau of WIPO, International Preliminary Report on Patentability for PCT/US2015/052618, dated Apr. 11, 2017, 5 pages.
Russia's Federal Institute of Industrial Property, Written Opinion of the International Searching Authority for PCT/US2015/052618, dated Feb. 18, 2016, 4 pages.
Russia's Federal Institute of Industrial Property, International Search Report for PCT/US2015/052618, dated Feb. 18, 2016, 2 pages.
European Patent Office; Communication Pursuant to Article 94(3) EPC for EP 14825566.4, dated Dec. 12, 2017, 5 pages.
Taiwanese Intellectual Property Office, Office Action and Search Report for TW Application No. 104132707, dated Jan. 24, 2019, with English translation, 9 pages.
Korean Intellectual Property Office, International Search Report for PCT/US2017/038912, dated Oct. 27, 2017, 3 pages.
Korean Intellectual Property Office, Written Opinion of the International Searching Authority for PCT/US2017/038912, dated Oct. 27, 2017, 9 pages.
The International Bureau of WIPO, International Preliminary Report on Patentability for PCT/US2017/038912, dated Dec. 25, 2018, 10 pages.
Korean Intellectual Property Office, International Search Report for PCT/US2018/018983, dated Jun. 21, 2018, 5 pages.
Korean Intellectual Property Office, Written Opinion of the International Searching Authority for PCT/US2018/018983, dated Jun. 21, 2018, 8 pages.
Korean Intellectual Property Office, International Search Report for PCT/US2018/038182, dated Oct. 17, 2018, 3 pages.
Korean Intellectual Property Office, Written Opinion of the International Searching Authority for PCT/US2018/038182, dated Oct. 17, 2018, 6 pages.
The International Bureau of WIPO, International Preliminary Report on Patentability for PCT/US2018/038182, dated Dec. 24, 2019, 7 pages.
European Patent Office, Communication pursuant to Article 94(3) EPC for EP 15849285.0, dated Nov. 18, 2019, 6 pages.
Canadian Intellectual Property Office, Examiner's Report for CA 3,037,138, dated Jun. 9, 2020, 5 pages.
European Patent Office, Communication pursuant to Article 94(3) EPC for EP 17816258.2, dated Jul. 24, 2020, 5 pages.
European Patent Office, Extended European Search Report for EP 18757751.5, dated Oct. 8, 2021, 8 pages.
European Patent Office, Extended European Search Report for EP 17816258.2, dated Oct. 18, 2019, 12 pages.
European Patent Office, Communication pursuant to Rule 164(a) EPC, Partial European Search Report for EP 18821166.8, dated Feb. 23, 2021, 12 pages.

* cited by examiner

PLASTIC CORRUGATED CONTAINER WITH SOFT SCORE LINE

CROSS-REFERENCE TO RELATED APPLICATIONS

The present application is a continuation of U.S. patent application Ser. No. 16/822,107, filed Mar. 18, 2020, which is a continuation of U.S. patent application Ser. No. 15/629,806, filed Jun. 22, 2017, now U.S. Pat. No. 10,625,916, which claims the benefit of U.S. Provisional Application No. 62/354,483, filed Jun. 24, 2016, the contents of which are incorporated herein by reference. U.S. patent application Ser. No. 15/629,806 is a continuation-in-part of U.S. application Ser. No. 14/580,810, filed Dec. 23, 2014, now U.S. Pat. No. 10,829,264, which claims the benefit of U.S. Provisional Application No. 61/920,570, filed Dec. 24, 2013, the contents of which are also incorporated herein by reference.

FEDERALLY SPONSORED RESEARCH OR DEVELOPMENT

N/A

FIELD OF THE INVENTION

The present invention generally relates to a plastic corrugated container or box having soft score lines separating the side walls from the flaps to enable the flaps to lay substantially flat against the outer surface of the side walls when in an open position.

BACKGROUND OF THE INVENTION

In certain instances, it is important to provide box containers which have top flaps that can be fully opened to lay flat against the outside of the box. In particular, automated filling machinery may have narrow passages for such boxes. Flaps that extend outward from the box may get caught in such machinery.

Paperboard boxes can be formed to have flaps that lay flat. However, for plastic corrugated boxes, the plastic in the score lines between the flaps and the side walls has memory that causes the flaps to spring back. This causes the flaps to move back toward a planar relationship with the side walls.

The present invention provides an improved score line for use with plastic corrugated boxes.

SUMMARY OF THE INVENTION

The present invention provides a plastic corrugated box having flaps that can be folded substantially flat against the outer surfaces of the side walls of the box, and which remain in that position without substantial spring back. That is, the flaps are separated from the side walls by soft or "lazy" score lines that remain substantially flat to provide an opening that can be filled without the need for holding or otherwise restraining the flaps in place.

In accordance with one aspect of the invention, a corrugated plastic box with a soft score line is provided. The box comprises a plurality of side walls formed from a corrugated plastic sheet of material. The box also comprises a first flap extending from a first one of the plurality of side walls. The first flap is also formed from a corrugated plastic sheet of material and is separated from the first one of the plurality of side walls by a first score line. The first score line is configured to allow the first flap to lay substantially flat against an outer surface of the first one of the plurality of side walls when the first flap is folded against the outer surface of the first one of the plurality of side walls.

The corrugated plastic sheets of material include a first outer layer of plastic, a second outer layer of plastic and a plurality of flutes between the first outer layer and the second outer layer. The box can be formed from a single blank of such material.

The first score line is formed to have an inwardly concave radius of 0.01 inches. This matches the radius of a convex rib of an anvil used in conjunction with an ultrasonic horn that can be used to form the score line. The first score line is configured to have substantially no spring back. In this regard, the flap will stay in an open position against the outer surface of the side wall once positioned there without the need for any mechanical restraint to keep it in place.

In addition to the first flap, the box can include the same score line for each of the flaps extending from each of the side walls forming the box. Preferably, this type of score line is used for the top flaps. It can optionally be used for the bottom flaps.

In accordance with another aspect of the invention, a method of forming a plastic box with a soft score line is provided. The method comprises providing a blank of corrugated plastic material having a plurality of side walls and a first flap extending from a first one of the plurality of side walls. The method includes forming a score line between the first flap and the first one of the plurality of side walls sufficiently wide such that the first flap is configured to lay substantially flat against an outer surface of the first one of the plurality of side walls when the first flap is folded against the outer surface of the first one of the plurality of side walls. This can also be done for flaps extending from each of the side walls.

The forming a score line step can comprise applying a rotary ultrasonic horn against the blank. The ultrasonic horn can include a contact segment (e.g., a rib) having a radius of 0.01 inches.

Alternatively, the forming a score line step can comprise applying a plunge ultrasonic horn against the blank, or applying heat and pressure to the blank.

The step of providing a blank of corrugated plastic material can comprise extruding a sheet of plastic having a first outer layer, a second outer layer and a plurality of flutes between the first outer layer and the second outer layer, forming fold lines on the sheet to form the plurality of side walls and cutting the sheet to form flaps extending from each of the plurality of side walls. Once the score line is formed, the method further includes forming the blank into a box shape. This latter step can be performed on automated machinery.

Further aspects of the invention are disclosed in the Figures, and are described herein.

BRIEF DESCRIPTION OF THE DRAWINGS

To understand the present invention, it will now be described by way of example, with reference to the accompanying drawings in which.

DETAILED DESCRIPTION

Figure 1:
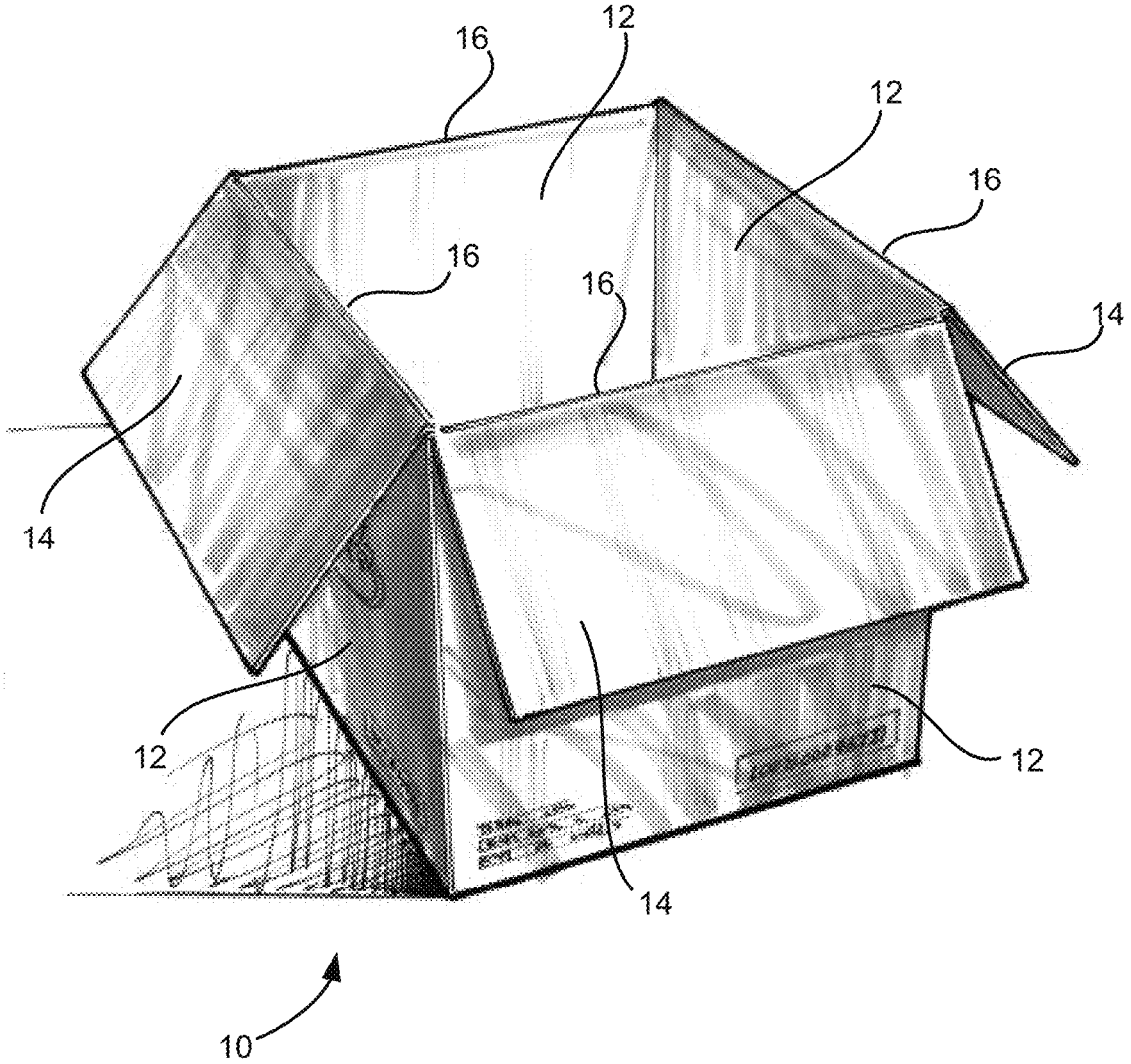
FIG. 1 is a perspective view of a plastic corrugated box having conventional score lines between the top flaps and the side walls.

While this invention is susceptible of embodiments in many different forms, there is shown in the drawings, and will herein be described in detail preferred embodiments of the invention with the understanding that the present disclosure is to be considered as an exemplification of the principles of the invention and is not intended to limit the broad aspect of the invention to the embodiments illustrated.

The present invention is directed to a plastic corrugated box having soft or "lazy" score lines separating the side walls and the flaps. The soft score lines allow the flaps to lay flat against the walls of the box when the flaps are opened. This enables the box to be more effectively filled, especially with automated machinery.

FIG. 1 shows a plastic corrugated box 10 with a plurality of side walls 12, and a plurality of top flaps 14 extending upward from the side walls (one flap for each side wall in this example—however a side wall can include multiple flaps). Typically, the flaps are simply extensions of the same material forming the side wall. Each flap 14 is separated from the respective side wall by a score line 16.

In the example of FIG. 1, the score lines 16 are formed in a conventional manner (here, conventional means both prior developments by the current applicants—which are the subject of pending patent applications—and earlier attempts by others in the industry) which causes the top flaps to tend to spring back. That is, the plastic in the score line retains a certain amount of memory that causes the score line to move the flap back toward a planar position with the side wall. In certain instances this is desired for plastic boxes that are going to be reused in box converting machinery which requires the flaps to be substantially planar with the side walls.

Figure 2:
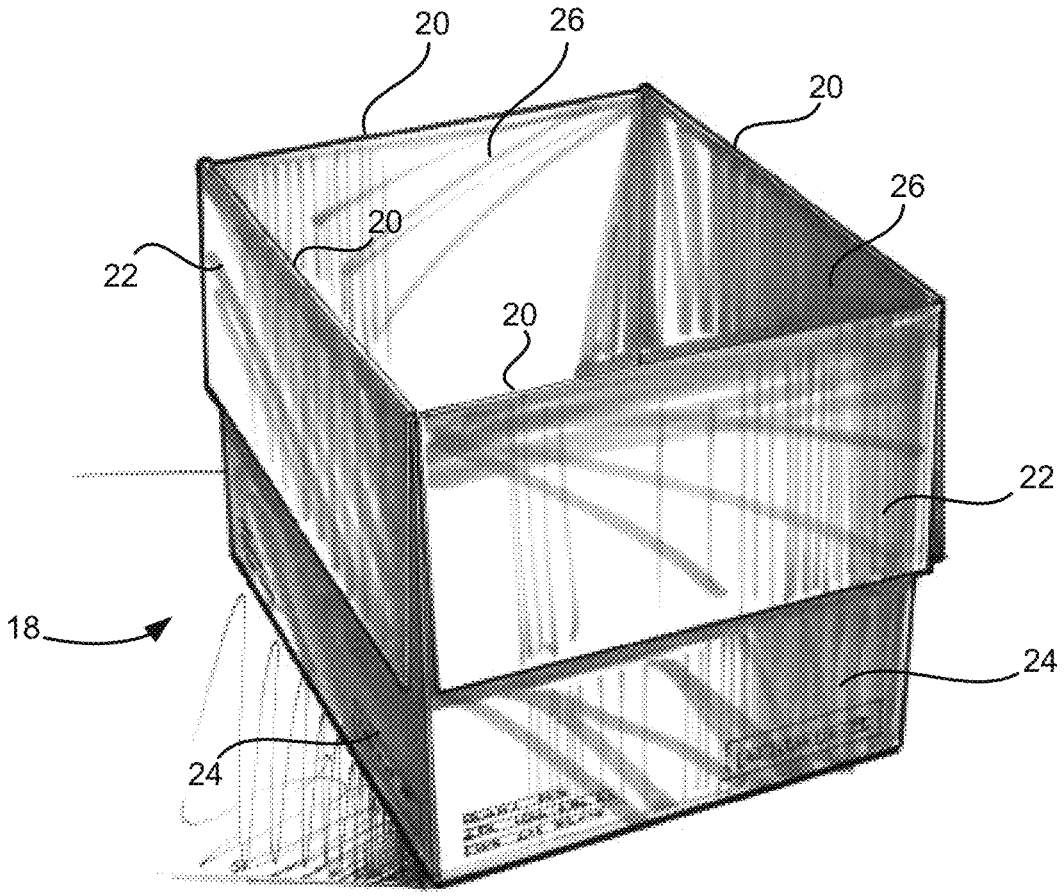
FIG. 2 is a perspective view of a plastic corrugated box with soft score lines between the top flaps and the side walls in accordance with the present invention

However, the score lines 16 formed in the conventional manner are not useful for situations where the box is filled in automated machinery that requires the top flaps to be substantially flat against the outer surface of the side walls. FIG. 2 shows a plastic corrugated box 18 with score lines 20 that allow the flaps 22 to lay substantially flat against the outer surface 24 of the side walls 26 in accordance with the present invention. As is evident in FIG. 2, the flaps 22 do not spring back to an upright or partial upright position (as that shown in FIG. 1).

The score lines 20 of the present invention are formed without slitting the corrugated plastic in this area. Providing one or more slits can sufficiently weaken the score line to act in a manner similar to that shown in FIG. 2. However, it opens and exposes the flutes in the interior of the corrugated plastic. This allows for water and other contaminants to enter this area.

Instead, in the present invention, the score lines 20 separating the top flaps from the side walls 26 are formed to be soft or "lazy" by reforming the corrugated plastic from the outer walls of the corrugated plastic sheet. Specifically, the score lines 20 are formed to be wider than conventional score lines. This can be done by use of a rotary ultrasonic horn and anvil, a plunge ultrasonic system, or by application of heat and pressure.

Figure 3:
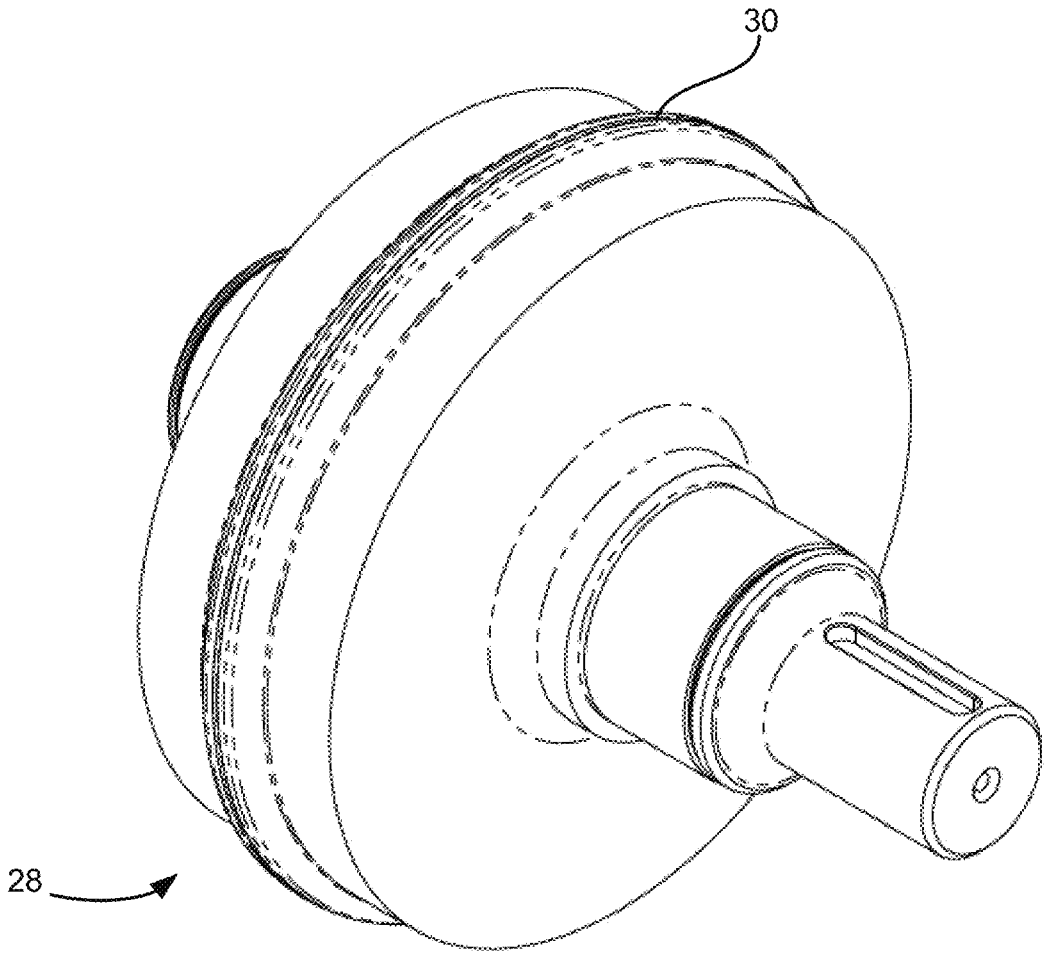
FIG. 3 is a perspective view of an ultrasonic horn for forming the soft score lines of the present inventions.
Figure 4:
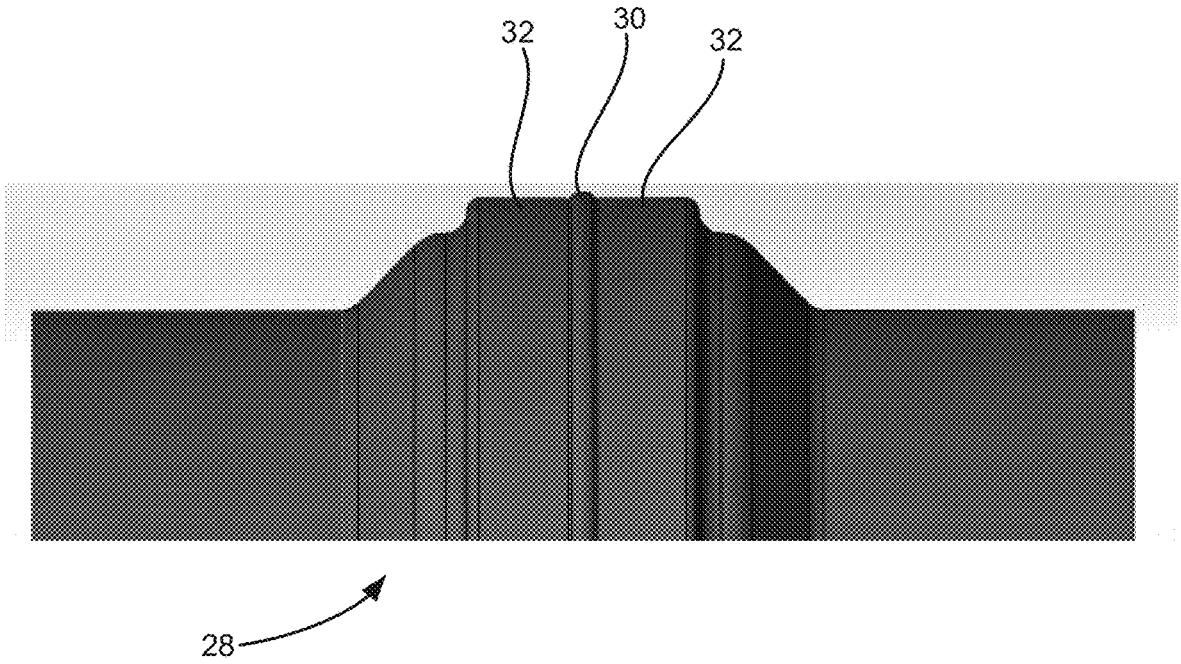
FIG. 4 is a side plan view of the ultrasonic horn.
Figure 5:
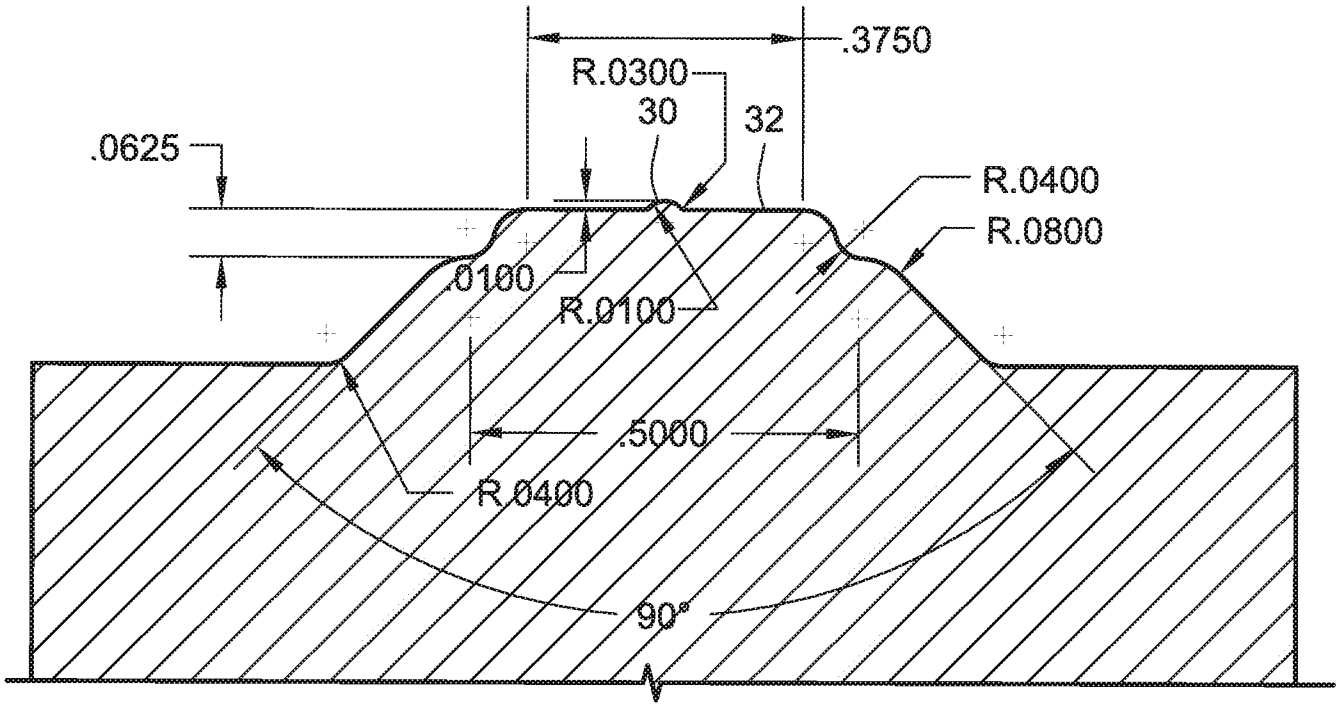
FIG. 5 is a cross-sectional view of the forming features of the ultrasonic horn.

One rotary ultrasonic horn 28 is shown in FIGS. 3-5. The ultrasonic horn 28 is in the form of a roller (see FIG. 3) having a score line forming rib 30. The rib is preferably formed to have a radius of 0.010 inches. The rib 30 blends into a flat portion 32 on either side of the rib 30. The transition from the rib 30 to the flat portions 32 has a radius of 0.030 inches.

The box can be formed from a single sheet of extruded plastic having a first outer sheet, a second outer sheet and a plurality of flutes between the first outer sheet and the second outer sheet. The sheet is then cut into a blank having fold lines separating side walls and cuts between the flaps. After forming the score lines of the present invention, the blank can then be erected in automated box forming machinery.

Many modifications and variations of the present invention are possible in light of the above teachings. It is, therefore, to be understood within the scope of the appended claims the invention may be protected otherwise than as specifically described.

I claim:

1. A process for forming a plastic box comprising:

providing a sheet of plastic corrugated material, the sheet having a plurality of side walls;

forming a first score line at a first end of a first side wall of the plurality of side walls to create a first flap extending upward from the first side wall, wherein the first flap will lay flat against the first side wall without spring back when the first flap is folded against the first side wall.

2. The process of claim 1 wherein the step of forming a first score line comprises:

using a plunge ultrasonic system on the sheet of plastic corrugated material.

3. The process of claim 1 wherein the step of forming a first score line comprises:

using heat and pressure on the sheet of plastic corrugated material.

4. The process of claim 1 wherein the sheet of corrugated plastic material is formed having a first outer layer, a second outer layer, and a plurality of flutes extending between the first outer layer and the second outer layer.

5. The process of claim 1 wherein the first score line is formed to have an inward concave radius of 0.01 inches.

6. The process of claim 1 further comprising:

forming a second score line at a first end of a second side wall of the plurality of side walls to create a second flap extending upward from the second side wall, wherein the second flap will lay flat against the second side wall when the second flap is folded against the second side wall.

7. The process of claim 6 further comprising:

forming a third score line at a first end of a third side wall of the plurality of side walls to create a third flap extending upward from the third side wall, wherein the third flap will lay flat against the third side wall when the third flap is folded against the third side wall.

8. The process of claim 7 further comprising:

forming a fourth score line at a first end of a fourth side wall of the plurality of side walls to create a fourth flap extending upward from the fourth side wall, wherein the fourth flap will lay flat against the fourth side wall when the fourth flap is folded against the fourth side wall.

9. The process of claim 8 further comprising:

cutting slots between the first flap, second flap, third flap and fourth flap.

10. The process of claim 8 wherein the step of forming a first score line comprises creating the first score line sufficiently wide such that the first flap does not have any spring back when the first flap is folded against the first side wall.

11. The process of claim 10 wherein the step of forming a second score line comprises creating the second score line sufficiently wide such that the second flap does not have any spring back when the second flap is folded against the second side wall.

12. The process of claim 11 wherein the step of forming a third score line comprises creating the third score line sufficiently wide such that the third flap does not have any spring back when the third flap is folded against the third side wall.

13. The process of claim 12 wherein the step of forming a fourth score line comprises creating the fourth score line sufficiently wide such that the fourth flap does not have any spring back when the fourth flap is folded against the fourth side wall.

14. A process for forming a plastic corrugated box comprising:

providing a generally rectangular sheet of plastic corrugated material;

forming a plurality of fold lines in the sheet defining a plurality of side walls;

using a plunge ultrasonic device to form a first fold line at an end of a first side wall of the plurality of side walls to define a first flap extending upward from the first side wall wherein the first flap will lay flat against an outer surface of the first side wall when in an open position.

15. The process of claim 14 further comprising:

using a plunge ultrasonic device to form a second fold line at an end of a second side wall of the plurality of side walls to define a second flap extending upward from the second side wall wherein the second flap will lay flat against an outer surface of the second side wall when in an open position.

16. The process of claim 15 further comprising:

using a plunge ultrasonic device to form a third fold line at an end of a third side wall of the plurality of side walls to define a third flap extending upward from the third side wall wherein the first flap will lay flat against an outer surface of the third side wall when in an open position.

17. The process of claim 16 further comprising:

using a plunge ultrasonic device to form a fourth fold line at an end of a fourth side wall of the plurality of side walls to define a fourth flap extending upward from the fourth side wall wherein the fourth flap will lay flat against an outer surface of the fourth side wall when in an open position.

18. The process of claim 17 further comprising:

cutting slots between the first flap, second flap, third flap and fourth flap.

19. The process of claim 14 wherein the plastic sheet of corrugated material includes a first outer layer, a second outer layer and a plurality of parallel flutes extending between the first outer layer and the second outer layer.

20. The process of claim 18 further comprising the step of forming the sheet of material into a box shape.

* * * * *